United States Patent [19]

Harms

[11] Patent Number: 4,627,608

[45] Date of Patent: Dec. 9, 1986

[54] VACUUM TAKE-OFF CONVEYOR

[75] Inventor: Jeffrey W. Harms, Olathe, Kans.

[73] Assignee: Gill Studios, Inc., Shawnee Mission, Kans.

[21] Appl. No.: 729,283

[22] Filed: May 1, 1985

[51] Int. Cl.[4] ..... B65H 3/12

[52] U.S. Cl. ..... 271/197; 271/96

[58] Field of Search ..... 271/197, 34, 35, 94, 271/96, 108

[56] References Cited

U.S. PATENT DOCUMENTS

| | | | |
|---|---|---|---|
| 3,123,354 | 3/1964 | Ungerer . | |
| 3,202,302 | 8/1965 | Insolio | 271/197 X |
| 3,321,121 | 5/1967 | Nyberg | 271/197 X |
| 3,328,027 | 6/1967 | Schmidtke . | |
| 3,477,558 | 11/1969 | Fleischauer . | |
| 3,500,999 | 3/1970 | Lippke | 271/197 X |
| 3,592,329 | 7/1971 | Fleischauer . | |
| 3,659,840 | 5/1972 | Ruck . | |
| 4,027,873 | 6/1977 | Bishop . | |
| 4,096,941 | 6/1978 | Tokuno | 271/197 X |
| 4,157,177 | 6/1979 | Strecker . | |
| 4,275,977 | 6/1981 | Joice . | |

FOREIGN PATENT DOCUMENTS

| | | | |
|---|---|---|---|
| 927701 | 5/1982 | U.S.S.R. | 271/197 |

*Primary Examiner*—Richard A. Schacher

*Attorney, Agent, or Firm*—Litman, Day and McMahon

[57] ABSTRACT

A vacuum take-off conveyor is used to transfer a printed sheet from a delivery conveyor to a sheet stacking apparatus. The vacuum conveyor has a vacuum chamber structure with an inner chamber. A vacuum source is connected to the chamber structure, near a first end thereof, and operates to create a pressure differential between the chamber and the surrounding atmosphere. The chamber structure is provided with longitudinal slots in a bottom wall to provide air communication from the atmosphere into the chamber. An endless foraminous belt is received onto the chamber structure to form a continuous loop from the first end to a second end thereof, and is rotated by a drive pulley. A damper, such as an adjustable damper plate, is situated within the chamber so as to produce a high vacuum region near the vacuum source between the damper plate and the first end of the chamber structure, and a low vacuum region between the damper plate and the chamber structure second end. Additionally, side walls of the chamber structure have a plurality of orifices therethrough, which apertures can be selectively closed or opened to affect the relative pressure differential between the high and low vacuum regions and the surrounding atmosphere.

8 Claims, 12 Drawing Figures

Fig.4.
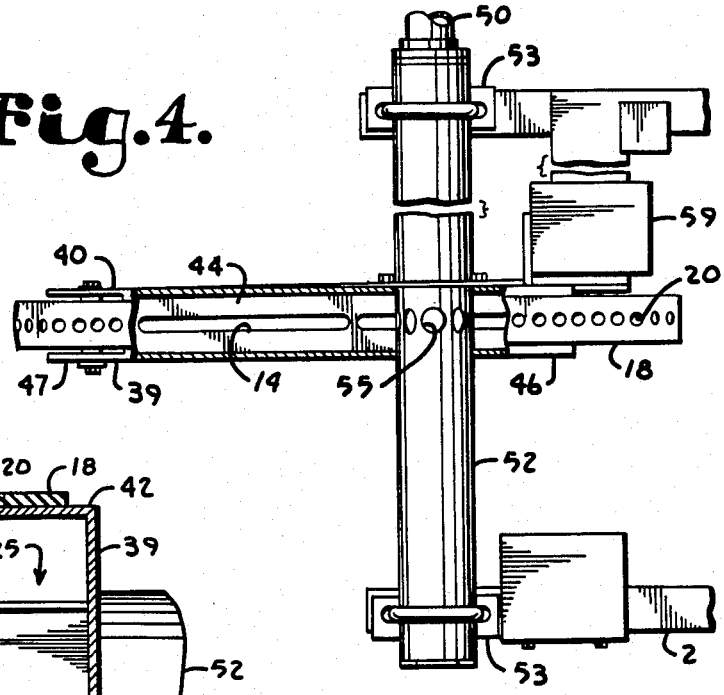
Fig.5.
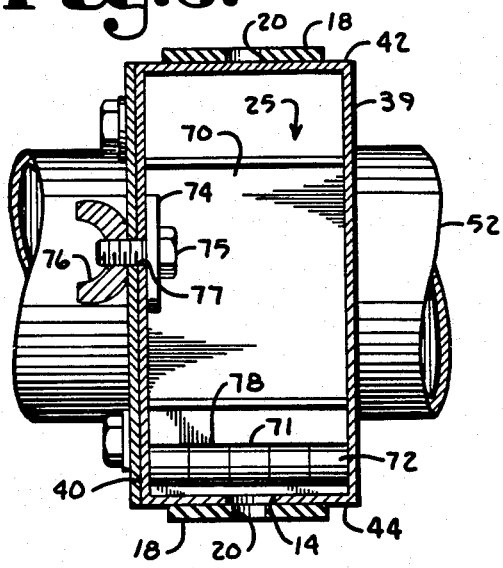
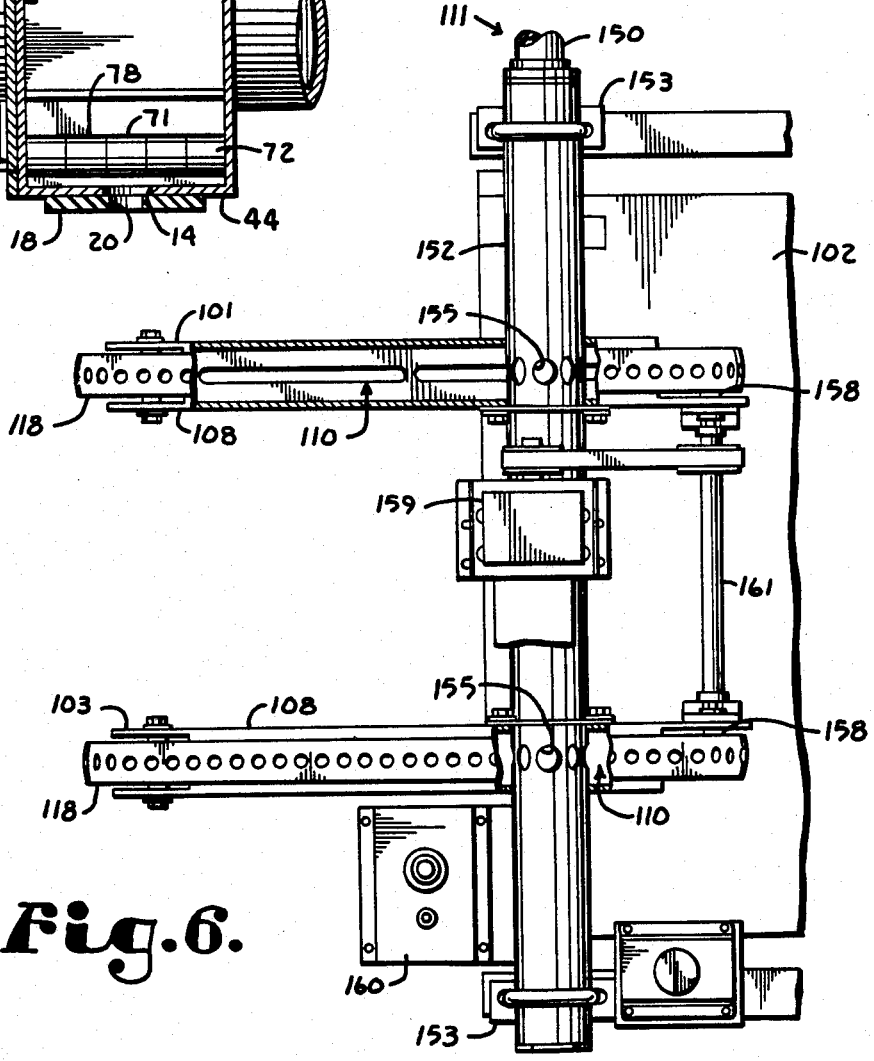
Fig.6.

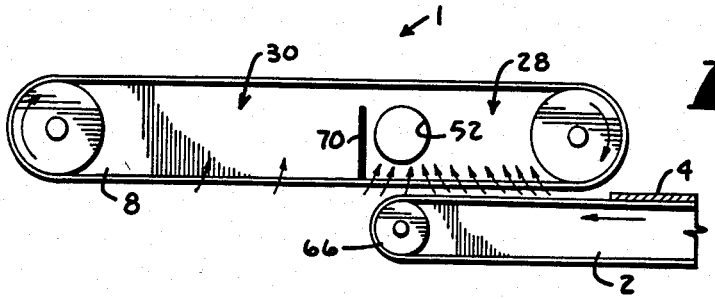
Fig. 7.
Fig. 8.
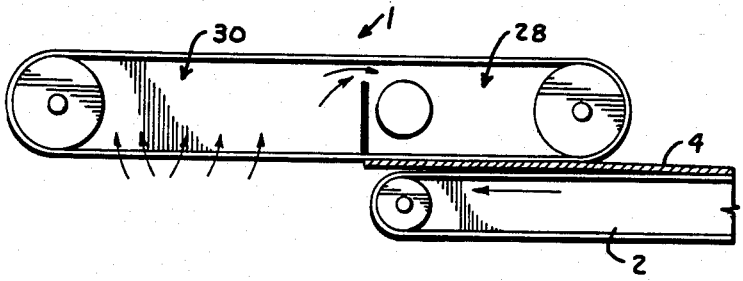
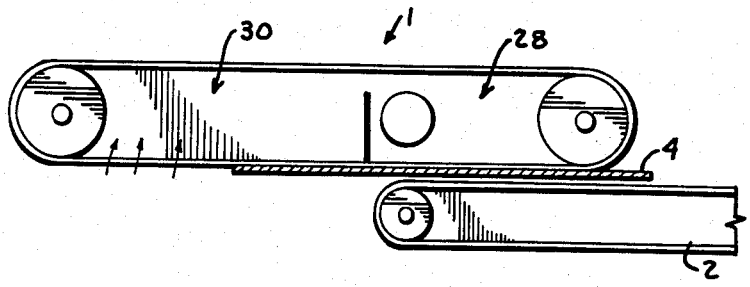
Fig. 9.
Fig. 10.
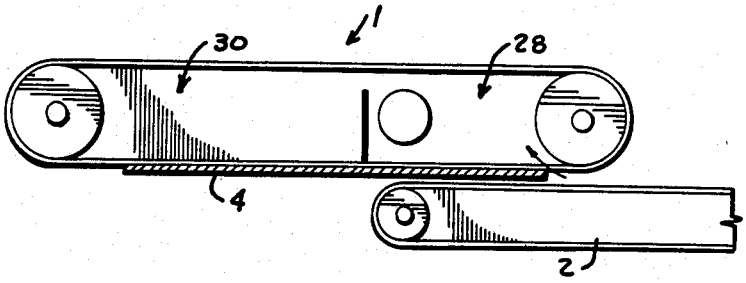
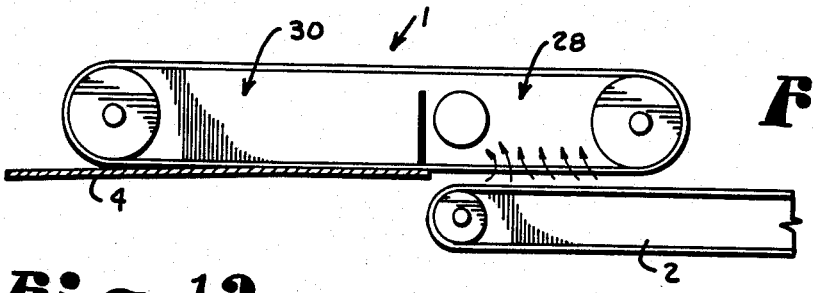
Fig. 11.
Fig. 12.
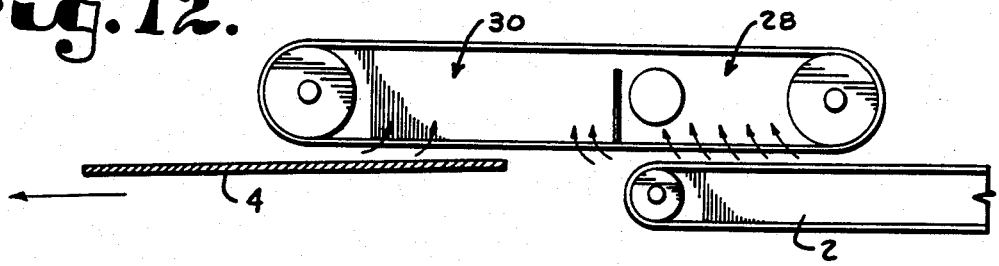

VACUUM TAKE-OFF CONVEYOR

BACKGROUND OF THE INVENTION

This invention relates to vacuum conveyors and particularly to such conveyors adapted to transfer printed sheets from a delivery conveyor to a sheet stacking apparatus.

Vacuum take-off conveyors are well known in the art as means to deliver an object from a delivery conveyor to a stacking area. One specific application of a vacuum conveyor is in silk screen printing, where printed sheets travel down a delivery conveyor after printing for ultraviolet ray drying and stacking. The vacuum conveyor is partially situated over a terminal end of the delivery conveyor. Sheets are "taken off" the delivery conveyor by the vacuum conveyor and delivered to a sheet stacking apparatus, such as a vibrating sheet stacker. The sheets are not damaged by this process and are delivered in a more controlled manner than would be the case if they were simply allowed to freely discharge from the end of the delivery conveyor.

Heretofore, insufficient control over the amount of suction present in the vacuum conveyor has been maintained. Most systems rely on the suction pressure to vary merely by the distance of the conveyor inlet apertures from the vacuum source. That is, the suction is greatest near the source and lessens as the conveyor extends away from the source. To initiate disengagement of the sheet or other article, the systems rely on the vacuum being low enough to allow passive release of the sheet, without much control over where that occurs.

Other systems provide for separation by sealing a section of the vacuum chamber so that air flow through the belt is stopped. Still others provide for active means, e.g., puff-off devices, to encourage separation by blowing air at the sheet through the conveyor belt.

Existing systems generally do not provide for variation of the flow of air within the vacuum chamber to increase or decrease the suction pressure as needed for the specific article to be conveyed. For example, curly and flimsy sheets of material require a relatively high vacuum to hold them to the conveyor without damage. It is also desirable to have a relatively higher suction pressure at the engagement position of the sheet to the vacuum conveyor to ensure that the sheet is properly controlled.

OBJECTS OF THE INVENTION

The principal objects of the present invention are: to provide a vacuum take-off conveyor for use with a delivery conveyor; to provide such a vacuum conveyor which receives a printed sheet and conveys it to a sheet stacking apparatus without damage to the sheet; to provide such a vacuum conveyor having dampening means for controlling or affecting the flow of air within a vacuum chamber; to provide such dampening means using a damper plate arrangement that is adjustable to create a high vacuum region and a low vacuum region; to further provide means for affecting the overall suction pressure within the vacuum chamber; to provide such a vacuum conveyor which is relatively simple to use, economical to manufacture and particularly well adapted for the proposed usage thereof.

Other objects and advantages of this invention will become apparent from the following description taken in conjunction with the accompanying drawings wherein are set forth, by way of illustration and example, certain embodiments of this invention.

SUMMARY OF THE INVENTION

A vacuum take-off conveyor has a vacuum chamber structure with an endless foraminous belt received thereon for transferring a printed sheet from a delivery conveyor to a sheet stacking apparatus. The chamber structure has a first end which receives a drive pulley for rotating the belt and a second end which receives an idler pulley. The chamber structure first end is positioned over a terminal end of the delivery conveyor so that articles can be transferred before they reach the terminal end of the delivery conveyor.

The delivery conveyor may be of essentially any construction, and specifically may be a conveyor associated with a silk screen printing process. Sheet materials are transported by the delivery conveyor during the printing and drying processes and the finished sheets are usually stacked at the terminal end of the delivery conveyor. The instant vacuum conveyor is provided to facilitate transfer of the sheet from the delivery conveyor terminal end to a sheet stacking apparatus.

The chamber structure has side walls and top and bottom walls which, together with the pulleys, define an inner chamber. The bottom wall has air communication means, such as a longitudinal slot, to allow air flow between the surrounding atmosphere and the inner chamber. Vacuum means are in flow communication with the chamber and create a pressure differential between the chamber and the surrounding atmosphere. Thus, during the suction process air flows from the surrounding atmosphere, through apertures in the belt and the slot, into the inner chamber and to the vacuum means. In practice, a pressure differential of about 2.5 pounds per square inch (psi) has been found to be adequate for certain silk screen printing processes.

Motive means, such as a variable speed motor, are included to rotate the drive pulley, which in turn rotates the belt, preferably in a loop from the drive pulley along the bottom wall to and around the idler pulley and back along the top wall to the drive pulley.

Dampening means are provided in the chamber to control or affect the flow of air therewithin. The dampening means preferably comprise an adjustable damper plate situated between the vacuum means and the idler pulley at the chamber structure second end, and positioned over the delivery conveyor terminal end. The damper plate impedes flow of air from the chamber between the damper plate and the idler pulley, to create a relatively low vacuum region. A relatively high vacuum region is developed between the damper plate and the drive pulley. This results in a high suction force above the terminal end of the delivery conveyor which facilitates pick-up of the sheets.

Additionally, suction control means are included for affecting the pressure differential between the vacuum chamber and the surrounding atmosphere. Preferably, the suction control means comprise a plurality of orifices in one of the side walls. Means, such as a sliding gate arrangement, are provided to selectively open and close the orifices, which results in decreasing or increasing the amount of suction applied through the vacuum chamber slots. A portion of the apertures are located in the side wall so as to correspond to the low vacuum region and a remaining portion of the orifices are located in the side wall so as to correspond to the high vacuum region. A sliding gate arrangement or the like is provided in each region to open or close the associated orifices, as determined by the operator. Alternatively, tape or other means of regulating flow through the orifices may be provided.

In an alternative embodiment, two chamber structures are provided side-by-side for handling larger sheets of material.

The drawings constitute a part of this specification and include exemplary embodiments of the present invention and illustrate various objects and features thereof.

BRIEF DESCRIPTION OF THE DRAWINGS

FIG. 4 is an enlarged, fragmentary top plan view of the vacuum take-off conveyor with portions broken away to show interior detail.

FIG. 5 is an enlarged, fragmentary cross-sectional view taken along line 5—5, FIG. 3.

FIG. 6 is a fragmentary, top plan view of a modified embodiment of the present invention showing a dual vacuum take-off conveyor system, with portions broken away to show interior detail.

FIGS. 7 through 12 are schematic drawings showing a transfer and release sequence of the vacuum take-off conveyor transferring a printed sheet from the delivery conveyor, conveying it and finally releasing the sheet.

DETAILED DESCRIPTION OF THE INVENTION

Figure 1:
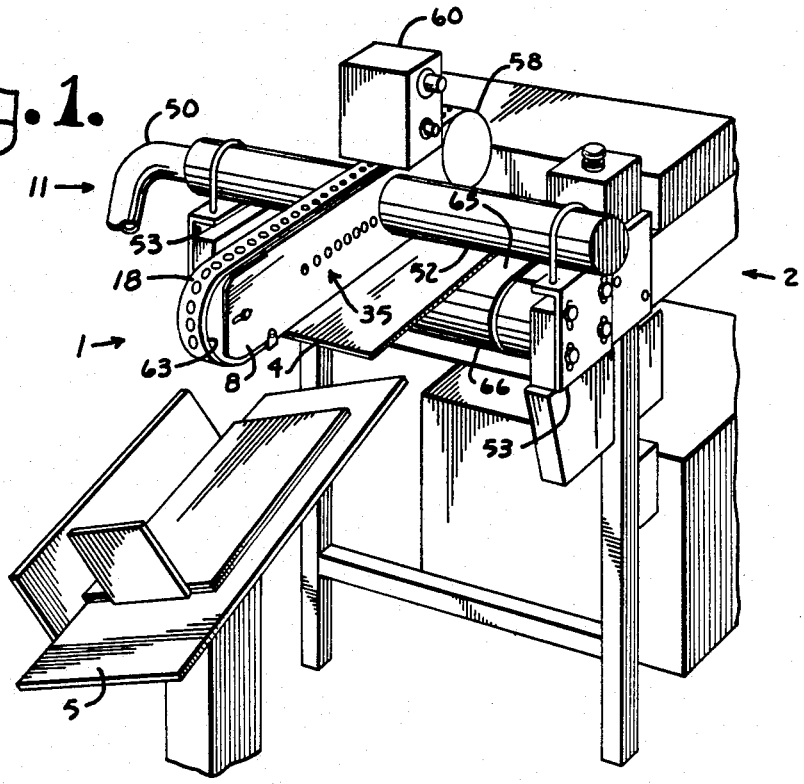
FIG. 1 is a perspective view of a vacuum take-off conveyor embodying the present invention shown in place on a delivery conveyor and in association with a sheet stacking apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally indicates a vacuum take-off conveyor of the present invention. The vacuum conveyor 1 is attached to a delivery conveyor 2 and used in combination therewith. The vacuum conveyor 1 is designed to transfer a printed sheet 4 from the delivery conveyor 2 to a sheet stacking apparatus, such as a vibrating sheet stacker 5.

The vacuum conveyor 1 includes a chamber structure 8 that defines an inner chamber 10. A vacuum source 11 is connected to the chamber structure 8 and operates to create a pressure differential between the chamber 10 and the ambient atmosphere. Air communication means, such as longitudinal slots 14, are located in the chamber structure 8 to allow air to flow from the atmosphere into the chamber 10.

An endless foraminous belt 18 is received onto the chamber structure 8, as is well known in the art. The belt 18 has a multiplicity of aligned apertures 20 along the length of the belt 18 and pass under the slots 14 as the belt 18 is power rotated. Dampening means 25 are situated within the chamber 10 and affect flow patterns of air within the chamber. The dampening means 25 create a high vacuum region 28 within the chamber 10 near the vacuum source 11 and generally associated with the area where the vacuum conveyor 1 is positioned over the delivery conveyor 2. A low vacuum region 30 is produced in an area away from the vacuum source 11.

Suction control means 35 are included in the chamber structure 8. The suction control means 35 are adjustable to affect and vary the relative pressure differential between the chamber 10 and the surrounding atmosphere. As illustrated, both the high and low vacuum regions 28 and 30 have suction control means 35 associated with them.

The vacuum chamber structure has opposed side walls 39 and 40, a top wall 42, and a bottom wall 44, as seen in Fig. 5. The chamber structure has a first end 46 near the delivery conveyor 2 and a second end 47 and is generally longitudinally aligned with the delivery conveyor 2.

As illustrated, the vacuum source 11 includes a hose 50 which connects to a device (not shown) for creating a pressure differential. Such apparatus for creating vacuums are well known and do not form a part of this invention. The hose 50 is also connected to a cylindrical, hollow drum 52 which passes transversely through the chamber structure 8, as seen in FIGS. 1 and 4. The chamber structure 8 is cut away around the drum 52 and the drum 52 snugly fits therethrough. The delivery conveyor 2 has opposed standards 53 which receive and support opposite ends of the drum 52, as seen in FIG. 1. Thus, the standards 53 and drum 52 substantially support the chamber structure 8.

The vacuum drum 52 has a plurality of circumferential openings 55 which provide air flow communication between the chamber 10 and the vacuum source.

A drive pulley 58 is rotatably connected to the chamber structure first end and is held between the side walls 39 and 40. The drive pulley 58 is operatively connected to motive means, such as a variable speed direct current (D.C.) motor 59 with speed control box 60, in a manner that is well known. The motor 59 is attached to the delivery conveyor 2 at one end and is connected to the drive pulley 58 at another end. This further supports the vacuum conveyor 1 in an elevated position over the delivery conveyor 2.

Figure 3:
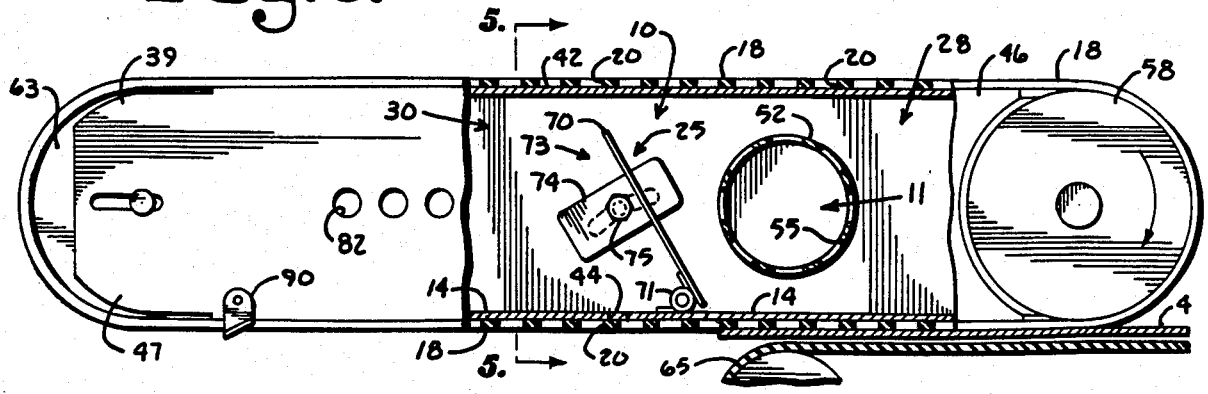
FIG. 3 is an enlarged, fragmentary side elevational view of the vacuum take-off conveyor with portions broken away to show interior detail.

An idler pulley 63 is rotatably connected to the second end 47 of the chamber structure 8 and is held between the side walls 39 and 40. The belt 18 forms a continuous loop over the drive pulley 58 at the chamber structure first end 46, along the bottom wall 44, over the idler pulley 63 at the chamber structure second end 47, and back along the top wall 42 to the drive pulley, as illustrated in FIG. 3. The drive pulley 58 and idler pulley 63 are crowned so that the belt 18 is self-centering on the pulleys.

The belt 18 is rotated about the loop by means of the drive pulley 58 in a generally clockwise rotation as the invention is illustrated in FIG. 3. The drive pulley 58 is positioned over a delivery belt 65 of the delivery conveyor 2, and the vacuum drum 52 is generally positioned above a terminal end 66 of the delivery conveyor 2. Thus, a substantial portion of the vacuum conveyor 1 is positioned over the delivery conveyor 2, for purposes explained below.

The dampening means 25 includes a damper plate 70 swingably connected to the bottom wall 44 within the chamber 10. A hinge arrangement 71 has a stationary section 72 attached to the bottom wall 44 and a pivot section 78 attached to the damper plate 70. The hinge arrangement 71 allows the damper plate 70 to rotate about an axis of the hinge arrangement 71. The damper plate 70 is swingable from a substantially vertical position, in an arc toward the chamber structure second end 47, to an inclined position. The damper plate may alternatively be attached to the chamber structure 8 in a fixed position. The high vacuum region 28 is defined between the damper plate 70 and the chamber structure first end 46. The vacuum drum 52 passes through the high vacuum region 28. The low vacuum region 30 is defined between the damper plate 70 and the chamber structure second end 47.

As shown in FIGS. 3 and 5, the damper plate 70 is connected to an adjusting apparatus 73, which includes a plate 74 attached to the damper plate 70, a bolt 75 and wingnut 76. The bolt 75 is attached to the plate 74 and extends through a slot 77 in the side wall 40. The slot 77 partially extends along an arc of the hinge arrangement 71 so that the adjusting apparatus 73 can be moved along the slot, which in turn moves the damper plate 70. The wingnut 76 is tightened to lock the damper plate 70 in a desired position.

The suction control means 35 include a plurality of bleed holes or orifices 82 in the side wall 39. A portion of the suction control orifices 82 are generally associated with the low vacuum region 30, and a remaining portion of the suction control orifices are generally associated with the high vacuum region 28. The size and number of the orifices 82 are determined by the amount of control and pressure fluctuation desired for the particular situation.

Figure 2:
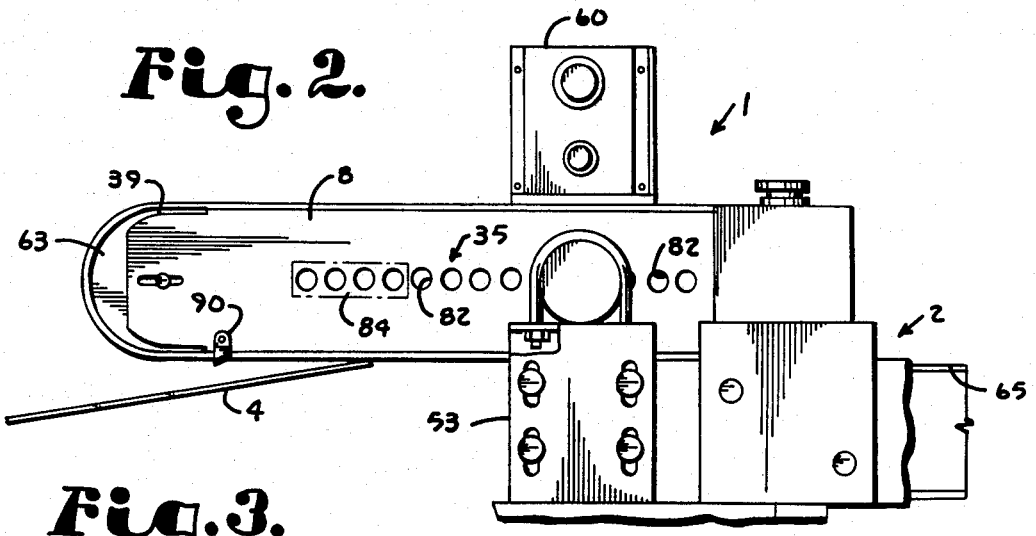
FIG. 2 is a fragmentary, enlarged side elevational view of the vacuum take-off conveyor.

As illustrated in FIG. 2, tape 84 or the like is placed over selected orifices 82 when it is desired to close them. Alternatively, a sliding gate arrangement (not shown) or similar apparatus can be used, in which case one of such apparatus would be included for each of the high and low vacuum regions 28 and 30.

A release device 90 may be attached to the chamber structure 8, near the second end 47 thereof. Separation of the sheet 4 from the belt 18 is facilitated by contact of a leading sheet edge with the release device 90. It is noted that the release device 90 is not required for normal operation of the vacuum conveyor 1, but has been found to be useful in some situations.

A modified embodiment of the present invention is shown in FIG. 6 and comprises dual vacuum conveyors 101 and 103. The structure of the paired vacuum conveyors 101 and 103 is substantially similar to the vacuum conveyor 1, and they are used when larger sheets of material are being printed or otherwise handled. The vacuum conveyors 101 and 103 are attached to and used in conjunction with a delivery conveyor 102, which is substantially similar to the delivery conveyor 2.

As with the vacuum conveyor 1, the dual vacuum conveyors 101 and 103 include a chamber structure 108, inner chamber 110, and an endless foraminous belt 118 with apertures 120. The dual vacuum conveyors 101 and 103 further include dampening means and suction control means, which are not shown but are substantially similar to the associated structures on the vacuum conveyor 1. A vacuum source 111 includes a vacuum hose 150, which connects to the vacuum-creating apparatus (not shown) at one end. A hollow, cylindrical drum 152 is attached to opposed delivery conveyor standards 153. Another end of the hose 150 connects to the drum 152, as seen in FIG. 6. The drum 152 extends transversely to the dual conveyors 101 and 103 and extends through appropriate openings in the respective chamber structures 108. Each vacuum drum 152 has a plurality of circumferential openings 155 that provide air flow communication between the vacuum source and the chambers 110. As illustrated, air flows directly from the chamber 110 of the vacuum conveyor 101 to the vacuum hose 150. Meanwhile, air flows from the chamber 110 of the other vacuum conveyor 103 through the openings 155 associated therewith, into the drum 152 toward the vacuum conveyor 101. The air then flows through the other openings 155 corresponding to the vacuum conveyor 101, into the associated chamber 110 to the vacuum hose 150.

Similar drive pulleys 158 are provided to power the belts 118. The drive pulleys 158 are connected by a common drive shaft 161, which is operatively connected to a variable speed D.C. motor 159 having a speed control box 160.

The function of the two vacuum conveyor systems is substantially similar and will be described together.

Referring to FIGS. 7–12, a transfer and release sequence is shown. The schematic illustrations show the vacuum conveyor 1 positioned over the delivery conveyor 2, with the vacuum drum 52 generally positioned above the delivery conveyor terminal end 66. The damper plate 70 is shown in a vertical orientation.

As seen in FIG. 7, the printed sheet 4 is traveling down the delivery conveyor 2 toward the vacuum conveyor 1. As indicated by the directional arrows, the damper plate 70 is affecting the air flow in the chamber 8, such that a greater pressure differential is present in the high vacuum region 28 as compared to the low vacuum region 30. The damper plate 70 serves to impede flow of air from the low vacuum region 30 to the vacuum drum 52, which magnifies the variance in the respective pressure differentials. The presence of the high vacuum region 28 serves to provide a greater suction over the delivery conveyor 2 to facilitate transfer of the sheet 4.

In FIG. 8, the sheet 4 has been transferred and is being carried along the vacuum conveyor bottom wall 44 by the belt 18. At this point, a high degree of suction is present in the high vacuum region 28. Essentially no air is flowing into the chamber 10 through the slot associated with the high vacuum region 28. That is, there is air flow only into the low vacuum region, which tends to increase the relative pressure differential along the bottom wall 44 at that point to better hold the sheet 4 to the belt 18 as it moves along.

In FIG. 9, the sheet 4 is approaching the point of maximum attraction or suction, and is securely held to the belt 18 away from the delivery conveyor 2. At the point of maximum attraction, substantially the entire length of the longitudinal slot 14 is covered by the sheet 4.

The point of maximum attraction has just been passed in FIG. 10. The trailing edge of the sheet 4 begins to open the high vacuum region 28 to air flow, and the suction applied to the sheet 4 is beginning to decrease.

The entire high vacuum region 28 is open in FIG. 11, and the sheet attraction is approaching a minimum amount, because sufficient air is being allowed to flow into the chamber 8. However, the sheet 4 is still held to the belt 18, but with substantially less attraction.

In FIG. 12, the low vacuum region 30 has been uncovered by the trailing edge of the sheet, allowing air flow into the region 30, initiating release of the sheet 4 from the conveyor. Alternatively, the release of the sheet may be initiated or facilitated by the depending release device 90, if the released device 90 is used on the vacuum conveyor 1.

The effective length of the vacuum conveyor 1 can be varied by covering a portion of the slot 14 from the outer end back to the desired point of sheet separation. Applicant has found that pressure sensitive tape may be used for this purpose.

A relative pressure differential between the high and low vacuum regions 28 and 30 can be changed by movement of the damper plate 70. Referring to FIG. 3, if the damper plate 70 is moved downwardly by swinging it counterclockwise, the relative pressure differential with respect to atmospheric pressure in the low vacuum region 30 increases, while the relative pressure differential in the high vacuum region 28 decreases slightly. Thus, the operator has control over the relative pressure differentials and can adjust them to suit his or her present needs, depending on the material to be transferred.

Also, the suction control orifices 82 can be used to individually affect the pressure differentials in the high and low vacuum regions 28 and 30. By covering one or more of the orifices 82 associated with the low vacuum region, the relative pressure differential in that region is increased, resulting in a higher amount of suction. A similar increase in suction pressure is achieved by covering one or more of the orifices 82 associated with the high vacuum region 28. Thus, by adjusting the damper plate 70 and opening or closing the suction control orifices 82, the operator has control over the suction pressures, without the need of adjusting the vacuum source itself. Because of the relatively high degree of control, various different types and consistencies of materials can be transferred effectively.

The variable speed motor 59 also provides the operator with a higher degree of flexibility. It can be adjusted so that the vacuum conveyor 1 is moving at the same speed as the delivery conveyor 2, as is normally the case. However, as needed, the vacuum conveyor speed can be adjusted to be faster or slower than the delivery conveyor speed, resulting in more control in receiving and releasing the sheets. Specifically, when the vacuum conveyor 1 is moving at a faster rate than the delivery conveyor 2, overlapping or shingled sheets can be more effectively stacked.

It is to be understood that while certain forms of the present invention have been illustrated and described herein, it is not to be limited to the specific forms or arrangement of parts described and shown.

What is claimed and desired to be secured by Letters Patent is as follows:

1. A vacuum take-off conveyor for transferring a printed sheet from the discharge end of a delivery conveyor to a sheet stacking apparatus, said vacuum take-off conveyor comprising:

(a) a vacuum chamber structure having side walls and top and bottom walls and defining a vacuum chamber therewithin; said side walls having respective first and second ends;

(b) a drive pulley associated with said side wall first ends and rotatable on an axis transverse to said side walls;

(c) adjustable motive means for rotating said drive pulley about said drive pulley axis at different rotational speeds;

(d) an idler pulley associated with said side wall second ends and rotatable on an axis transverse to said side walls;

(e) an endless foraminous belt having a multiplicity of apertures extending along a length of said belt; said belt being received on said chamber structure so as to run as a loop around said drive pulley and said idler pulley and along said top and bottom walls; said belt being engaged by said drive pulley so as to be responsive to rotation of said drive pulley, whereby said belt generally moves in a continuous loop between said first and second ends along said bottom wall and away from said delivery conveyor and toward said sheet stacking apparatus;

(f) vacuum means for creating a lower air pressure within said vacuum chamber than in the surrounding atmosphere;

(g) air communication means along said vacuum chamber bottom wall to allow air to flow from the surrounding atmosphere through said belt apertures and into said vacuum chamber, whereby a suction is created along a portion of said belt traveling along said air communication means;

(h) damping means situated within said vacuum chamber; said damping means separating said vacuum chamber into a high vacuum region and a low vacuum region, said high vacuum region being situated in close proximity and above said delivery conveyor discharge end such that a sheet on said delivery conveyor is delivered beneath and adjacent the high vacuum region of said vacuum chamber and is sucked upwardly against said belt and moved toward said low vacuum region where it adheres to said belt with lesser force to facilitate discharge from beneath said belt onto said sheet stacking apparatus; and (i) said damping means including a plate adjustably extending generally between said top and bottom walls and defining a space therebetween for adjustably modifying air flow communication between said high and low vacuum regions.

2. The vacuum take-off conveyor as set forth in claim 1 wherein:

(a) said damping means plate is pivotally mounted adjacent said bottom wall for varying said air flow communication between said high and low vacuum regions.

3. The vacuum take-off conveyor as set forth in claim 2 further including:

(a) a hinge arrangement having a stationary section attached to said chamber structure bottom wall and a pivot section attached to said plate; and (b) an adjusting apparatus attached to said plate and extending through one of said side walls to allow manipulation of said plate from outside of said chamber, said adjusting apparatus including means to lock said plate in a desired position.

4. The vacuum take-off conveyor as set forth in claim 1 further including:

(a) suction control means in one of said side walls for affecting the pressure differential between said vacuum chamber and said surrounding atmosphere.

5. The vacuum take-off conveyor as set forth in claim 1 wherein:

(a) said vacuum means includes a vacuum drum connected to said chamber structure and in flow communication with said chamber, and (b) said vacuum drum is connected to said chamber structure at a location between said chamber structure first end and said damper plate.

6. The vacuum take-off conveyor as set forth in claim 5 wherein:

(a) said vacuum drum is adapted to be attached to the delivery conveyor, whereby said chamber structure is supported by said vacuum drum and delivery conveyor.

7. The vacuum take-off conveyor as set forth in claim 1 wherein:

(a) a pair of said vacuum chamber structures are provided in side-by-side relationship, and (b) each of said pair of vacuum chamber structures has an endless belt, air communication means, damper means, and means for affecting the pressure differential between said vacuum chamber and said surrounding atmosphere.

8. A method of transferring a sheet from a delivery conveyor to a sheet stacking apparatus by means of a vaccum take-off conveyor comprising the steps of:

(a) providing a vacuum take-off conveyor having a vacuum chamber structure with sidewalls and top and bottom walls for defining a chamber within said walls, said walls having respective first and second ends; said vacuum take-off conveyor having a damper plate extending substantially between said top and bottom walls and defining a space therebetween for allowing air flow communication between a high vacuum region and a low vacuum region, said high vacuum region being generally situated between said chamber structure first end and said damper plate and said low vacuum region being generally situation between said damper plate and said chamber structure second end;

(b) presenting a printed sheet from a delivery conveyor to said vacuum take-off conveyor;

(c) transferring said sheet upwardly from said delivery conveyor to said vacuum take-off conveyor by utilization of the high vacuum region of said vacuum take-off conveyor to achieve a secure transfer of said sheet without relative movement between said sheet and said vacuum take-off conveyor upon transfer of said sheet;

(d) transferring said sheet along said vacuum take-off conveyor along a section of said conveyor associated with said high vacuum region and towards a section of said conveyor associated with said low vacuum region until said sheet substantially covers the sections of said conveyor associated with said high and low vacuum regions.

(e) opening said high vacuum region to the atmosphere as said sheet is conveyed, whereby the attraction of said conveyor for said sheet is reduced as said sheet is conveyed toward said section of said conveyor associated with said low vacuum region; and (f) releasing said sheet from said conveyor upon further opening of said high vacuum region to said atmosphere.

* * * * *